US010357822B2

(12) United States Patent
Parrish et al.

(10) Patent No.: US 10,357,822 B2
(45) Date of Patent: Jul. 23, 2019

(54) TITANIUM-COPPER-IRON ALLOY AND ASSOCIATED THIXOFORMING METHOD

(71) Applicants: The Boeing Company, Chicago, IL (US); Universidade Estadual De Campinas, Campinas OT SP (BR)

(72) Inventors: Catherine J. Parrish, San Jose dos Campos (BR); Rubens Caram, Campinas (BR); Kaio Niitsu Campo, Campinas (BR); Caio Chausse de Freitas, Campinas (BR)

(73) Assignees: The Boeing Company, Chicago, IL (US); Universidade Estadual De Campinas, Campinas (BR)

( * ) Notice: Subject to any disclaimer, the term of this patent is extended or adjusted under 35 U.S.C. 154(b) by 213 days.

(21) Appl. No.: 15/472,948

(22) Filed: Mar. 29, 2017

(65) Prior Publication Data

US 2018/0281054 A1 Oct. 4, 2018

(51) Int. Cl.

| | |
|---|---|
| ***B22D 17/00*** | (2006.01) |
| ***C22C 14/00*** | (2006.01) |
| ***B22D 21/00*** | (2006.01) |

(52) U.S. Cl.

CPC ..... *B22D 17/007* (2013.01); *B22D 21/005* (2013.01); *C22C 14/00* (2013.01)

(58) Field of Classification Search

CPC ..... B22D 17/007; C22C 14/00
USPC ..... 164/113, 900
See application file for complete search history.

(56) References Cited

U.S. PATENT DOCUMENTS

| | | | | |
|---|---|---|---|---|
| 4,568,398 | A | 2/1986 | Wood et al. | |
| 5,865,238 | A * | 2/1999 | Carden | B22D 17/007 164/113 |
| 6,666,258 | B1 * | 12/2003 | Kono | B22D 17/28 164/312 |
| 2002/0007883 | A1 * | 1/2002 | Doutre | B22D 17/007 148/549 |
| 2010/0192727 | A1 * | 8/2010 | Withers | B22D 17/007 75/10.67 |

FOREIGN PATENT DOCUMENTS

| | | |
|---|---|---|
| GB | 2156 850 | 10/1985 |
| WO | WO 98/03686 | 1/1998 |

OTHER PUBLICATIONS

Lu et al., "Phase constitution and microstructure evolution of rapidly solidified Ti—Cu—Fe alloy," Acta Physica Sinica, vol. 61, No. 21, 216102 (Year: 2012).*

He et al., "Effect of composition of microstructure and compressive mechanical properties in Ti—Cu—Fe—Sn—Nb alloys," Materials Transactions, vol. 45, No. 5, pp. 1555-1560 (Year: 2004).*

Chen et al., Effect of Cu concentration on the semi-solid deformation behavior and microstructure of Ti—Cu alloy, *Advances in Mechanical Engineering*, v. 7, p. 1-10, (2015).

Flemings, Semi-solid forming: the process and the path forward, *Metallurgical Science and Technology*, v. 18, p. 3-4, (2000).

(Continued)

*Primary Examiner* — Kevin E Yoon

(74) *Attorney, Agent, or Firm* — Walters & Wasylyna LLC

(57) ABSTRACT

A titanium alloy that includes about 5 to about 33 percent by weight copper, about 1 to about 8 percent by weight iron, and titanium.

20 Claims, 5 Drawing Sheets

(56) References Cited

OTHER PUBLICATIONS

European Patent Office, "Extended European Search Report," App. No. 18164884.1 (dated Jun. 15, 2018).
Cardoso F.F et al: "Hexagonal martensite decomposition and phase precipitation in TiCu alloys", Materials and Design, London GB. vol. 32, No. 8, (Mar. 16, 2011).
Yongnan Chen et al: "Effect of Cu Content on thee Semi-Solid Formability and Mechanical Properties of Ti—Cu Alloys", Rare Metal Materials and Engineering, vol. 45, No. 6 (Jun. 1, 2016).
Zhang Erlin et al: "Effect of extrusion processing on the microstructure, mechanical properties, biocorrosion properties and antibacterial properties of Ti—Cu sintered alloys", Materials Science and Engineering C, Elsevier Science S.A. CH, vol. 69, (Jul. 20, 2016).

* cited by examiner

TITANIUM-COPPER-IRON ALLOY AND ASSOCIATED THIXOFORMING METHOD

FIELD

This application relates to titanium alloys and, more particularly, to thixoforming of titanium alloys.

BACKGROUND

Titanium alloys offer high tensile strength over a broad temperature range, yet are relatively light weight. Furthermore, titanium alloys are resistant to corrosion. Therefore, titanium alloys are used in various demanding applications, such as aircraft components, medical devices and the like.

Plastic forming of titanium alloys is a costly process. The tooling required for plastic forming of titanium alloys must be capable of withstanding heavy loads during deformation. Therefore, the tooling for plastic forming of titanium alloys is expensive to manufacture and difficult to maintain due to high wear rates. Furthermore, it can be difficult to obtain complex geometries when plastic forming titanium alloys. Therefore, substantial additional machining is often required to achieve the desired shape of the final product, thereby further increasing costs.

Casting is a common alternative for obtaining titanium alloy products having more complex shapes. However, casting of titanium alloys is complicated by the high melting temperatures of titanium alloys, as well as the excessive reactivity of molten titanium alloys with mold materials and ambient oxygen.

Accordingly, titanium alloys are some of the most difficult metals to be processed in a cost-effective manner. Therefore, those skilled in the art continue with research and development efforts in the field of titanium alloys.

SUMMARY

In one embodiment, the disclosed titanium alloy includes about 5 to about 33 percent by weight copper, about 1 to about 8 percent by weight iron, and titanium.

In another embodiment, the disclosed titanium alloy consists essentially of about 5 to about 33 percent by weight copper, about 1 to about 8 percent by weight iron, and balance titanium.

In yet another embodiment, the disclosed titanium alloy consists essentially of about 13 to about 33 percent by weight copper, about 3 to about 5 percent by weight iron, and balance titanium.

In one embodiment, the disclosed method for manufacturing a metallic article includes the steps of (1) heating a mass of titanium alloy to a thixoforming temperature, the thixoforming temperature being between a solidus temperature of the titanium alloy and a liquidus temperature of the titanium alloy, the titanium alloy including copper, iron and titanium; and (2) forming the mass into the metallic article while the mass is at the thixoforming temperature.

In another embodiment, the disclosed method for manufacturing a metallic article includes the steps of (1) heating a mass of titanium alloy to a thixoforming temperature, the thixoforming temperature being between a solidus temperature of the titanium alloy and a liquidus temperature of the titanium alloy, the titanium alloy including about 5 to about 33 percent by weight copper, about 1 to about 8 percent by weight iron, and titanium; and (2) forming the mass into the metallic article while the mass is at the thixoforming temperature.

Other embodiments of the disclosed titanium-copper-iron alloy and associated thixoforming method will become apparent from the following detailed description, the accompanying drawings and the appended claims.

DETAILED DESCRIPTION

Figure 1:
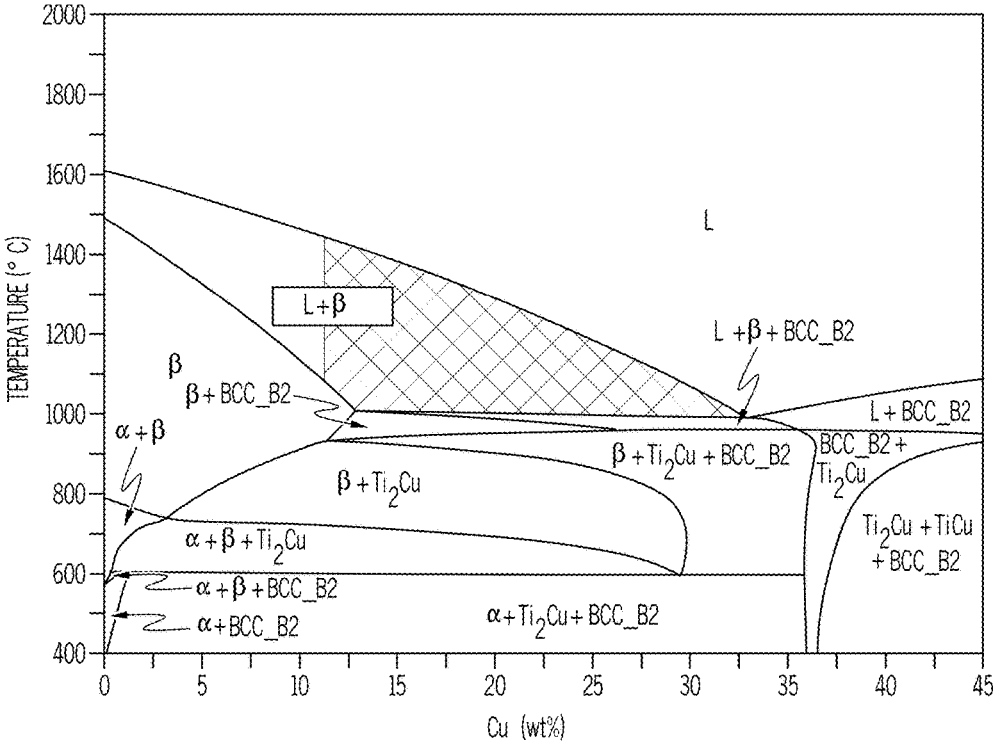
FIG. 1 is a phase diagram of a titanium-copper-iron alloy.

Disclosed is a titanium-copper-iron alloy. When the compositional limits of the copper addition and the iron addition in the disclosed titanium-copper-iron alloy are controlled as disclosed herein, the resulting titanium-copper-iron alloy may be particularly well-suited for use in the manufacture of metallic articles by way of thixoforming.

Without being limited to any particular theory, it is believed that the disclosed titanium-copper-iron alloys are well-suited for use in the manufacture of metallic articles by way of thixoforming because the disclosed titanium-copper-iron alloys have a relatively broad solidification range. As used herein, "solidification range" refers to the difference ($\Delta T$) between the solidus temperature and the liquidus temperature of the titanium-copper-iron alloy, and is highly dependent upon alloy composition. As one example, the solidification range of the disclosed titanium-copper-iron alloys may be at least about 50° C. As another example, the solidification range of the disclosed titanium-copper-iron alloys may be at least about 100° C. As another example, the solidification range of the disclosed titanium-copper-iron alloys may be at least about 150° C. As another example, the solidification range of the disclosed titanium-copper-iron alloys may be at least about 200° C. As another example, the solidification range of the disclosed titanium-copper-iron alloys may be at least about 250° C. As another example, the solidification range of the disclosed titanium-copper-iron alloys may be at least about 300° C.

The disclosed titanium-copper-iron alloys become thixoformable when heated to a temperature between the solidus temperature and the liquidus temperature of the titanium-copper-iron alloy. However, the advantages of thixoforming are limited when the liquid fraction of the titanium-copper-iron alloy is too high (processing becomes similar to casting) or too low (processing becomes similar to plastic metal forming). Therefore, it may be advantageous to thixoform when the liquid fraction of the titanium-copper-iron alloy is between about 30 percent and about 50 percent.

Without being limited to any particular theory, it is further believed that the disclosed titanium-copper-iron alloys are well-suited for use in the manufacture of metallic articles by way of thixoforming because the disclosed titanium-copper-iron alloys achieve a liquid fraction between about 30 percent and about 50 percent at temperatures significantly below traditional titanium alloy casting temperatures. In one expression, the disclosed titanium-copper-iron alloys achieve a liquid fraction between about 30 percent and about 50 percent at a temperature less than 1,200° C. In another expression, the disclosed titanium-copper-iron alloys achieve a liquid fraction between about 30 percent and about 50 percent at a temperature less than 1,150° C. In another expression, the disclosed titanium-copper-iron alloys achieve a liquid fraction between about 30 percent and about 50 percent at a temperature less than 1,100° C. In another expression, the disclosed titanium-copper-iron alloys achieve a liquid fraction between about 30 percent and about 50 percent at a temperature less than 1,050° C. In yet another expression, the disclosed titanium-copper-iron alloys achieve a liquid fraction between about 30 percent and about 50 percent at a temperature of about 1,010° C.

In one embodiment, disclosed is a titanium-copper-iron alloy having the composition shown in Table 1.

TABLE 1

| Element | Range (wt %) |
|---|---|
| Cu | 5-33 |
| Fe | 1-8 |
| Ti | Balance |

Thus, the disclosed titanium-copper-iron alloy may consist of (or consist essentially of) titanium (Ti), copper (Cu) and iron (Fe).

Those skilled in the art will appreciate that various impurities, which do not substantially affect the physical properties of the disclosed titanium-copper-iron alloy, may also be present, and the presence of such impurities will not result in a departure from the scope of the present disclosure. For example, the impurities content of the disclosed titanium-copper-iron alloy may be controlled as shown in Table 2.

TABLE 2

| Impurity | Maximum (wt %) |
|---|---|
| O | 0.25 |
| N | 0.03 |
| Other Elements, Each | 0.10 |
| Other Elements, Total | 0.30 |

The copper addition to the disclosed titanium-copper-iron alloy increases the liquid fraction at a given temperature. Therefore, without being limited to any particular theory, it is believed that the copper addition contributes to the thixoformability of the disclosed titanium-copper-iron alloy.

As shown in Table 1, the compositional limits of the copper addition to the disclosed titanium-copper-iron alloy range from about 5 percent by weight to about 33 percent by weight. In one variation, the compositional limits of the copper addition range from about 13 percent by weight to about 33 percent by weight. In another variation, the compositional limits of the copper addition range from about 15 percent by weight to about 30 percent by weight. In another variation, the compositional limits of the copper addition range from about 17 percent by weight to about 25 percent by weight. In yet another variation, the compositional limits of the copper addition range from about 18 percent by weight to about 22 percent by weight.

Iron is a strong β-stabilizer, but can increase density and cause embrittlement. Therefore, without being limited to any particular theory, it is believed that the iron addition retains the Ti-β phase during cooling, but without an excessive density increase and without causing significant embrittlement.

As shown in Table 1, the compositional limits of the iron addition to the disclosed titanium-copper-iron alloy range from about 1 percent by weight to about 8 percent by weight. In one variation, the compositional limits of the iron addition range from about 2 percent by weight to about 7 percent by weight. In another variation, the compositional limits of the iron addition range from about 3 percent by weight to about 6 percent by weight. In another variation, the compositional limits of the iron addition range from about 3 percent by weight to about 5 percent by weight. In yet another variation, iron is present at a concentration of about 4 percent by weight.

EXAMPLE 1

Ti-13-33Cu-4Fe

One general, non-limiting example of the disclosed titanium-copper-iron alloy has the composition shown in Table 3.

TABLE 3

| Element | Concentration (wt %) |
|---|---|
| Cu | 13-33 |
| Fe | 4 |
| Ti | Balance |

Referring to the phase diagram of FIG. 1, specifically to the cross-hatched region of FIG. 1, the disclosed Ti-13-33Cu-4Fe alloy has a relatively low solidus temperature (around 1,000° C.) and a relatively broad solidification range. Therefore, the disclosed Ti-13-33Cu-4Fe alloy is well-suited for thixoforming.

EXAMPLE 2

Ti-18Cu-4Fe

One specific, non-limiting example of the disclosed titanium-copper-iron alloy has the following nominal composition:

Ti-18Cu-4Fe and the measured composition shown in Table 4.

TABLE 4

| Element | Concentration (wt %) |
|---|---|
| Ti | Balance |
| Cu | 17.7 ± 0.6 |
| Fe | 4.0 ± 0.1 |
| O | 0.155 ± 0.006 |
| N | 0.008 ± 0.001 |

Figure 2A:
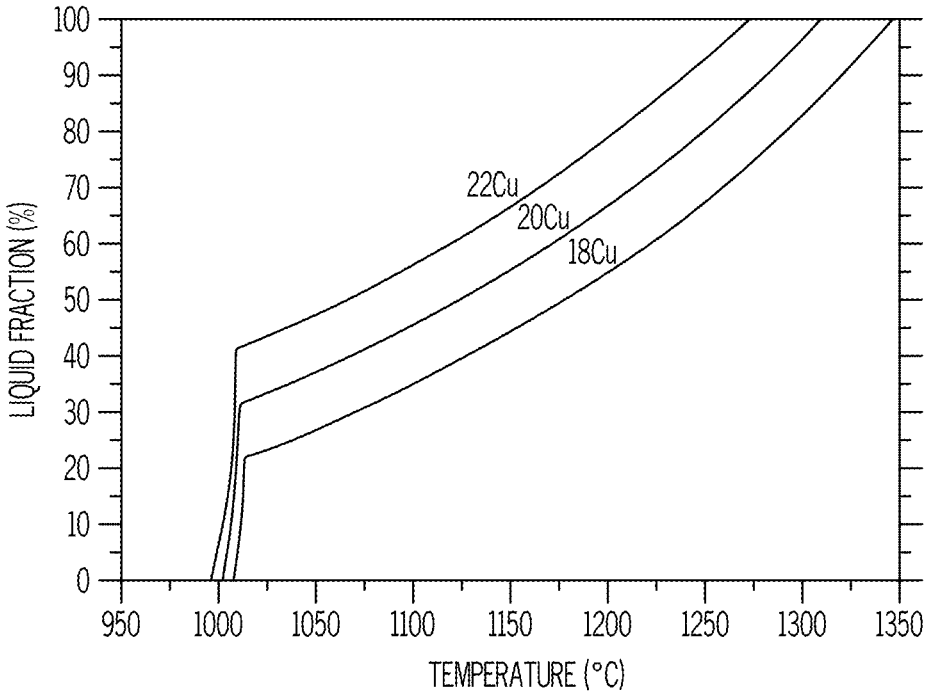
FIGS. 2A and 2B are plots of liquid fraction versus temperature for three example titanium alloys generated assuming equilibrium (FIG. 2A) and Scheil (FIG. 2B) conditions.
Figure 2B:
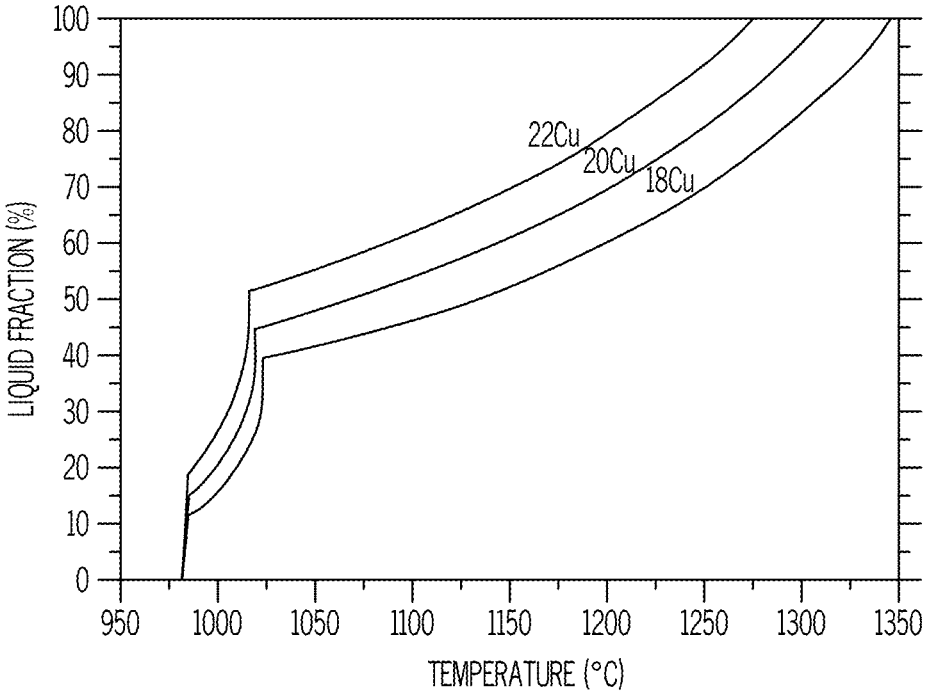

PANDAT™ software (version 2014 2.0) from CompuTherm LLC of Middleton, Wis., was used to generate liquid fraction versus temperature data for the disclosed Ti-18Cu-4Fe alloy, assuming both equilibrium conditions and Scheil conditions. The results are shown in FIGS. 2A (equilibrium conditions) and 2B (Scheil conditions). Based on the data from FIG. 2A (equilibrium conditions), the disclosed Ti-18Cu-4Fe alloy has a solidus temperature of about 1,007° C. and a liquidus temperature of about 1,345° C., with a solidification range of about 338° C. (364° C. using Scheil conditions/FIG. 2B).

Figures 3A, 3B, 3C:
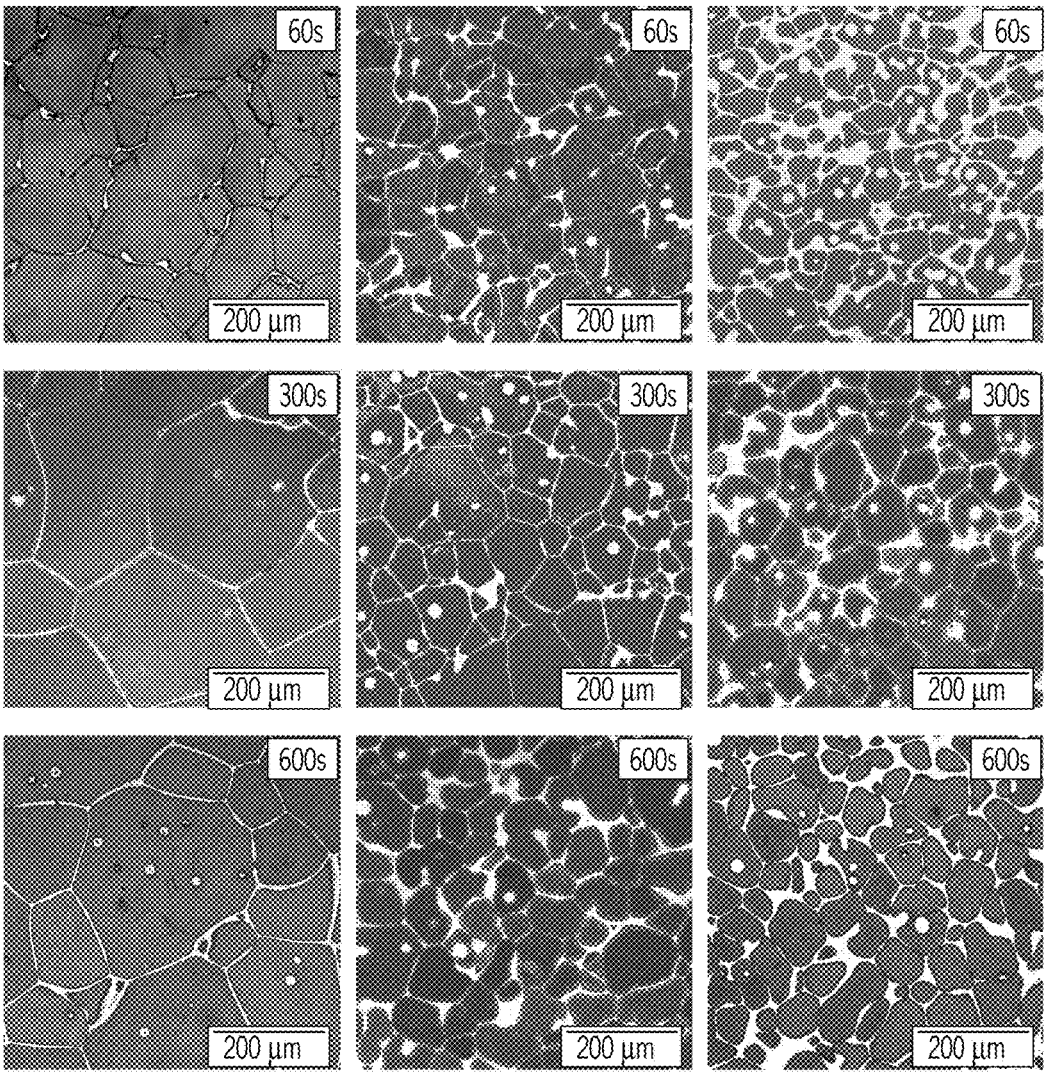
FIGS. 3A, 3B and 3C are photographic images depicting the microstructures versus time (when maintained at 1010° C.) for three example titanium alloys, specifically Ti-18Cu-4Fe (FIG. 3A), Ti-20Cu-4Fe (FIG. 3B) and Ti-22Cu-4Fe (FIG. 3C)

Referring to FIG. 3A, the disclosed Ti-18Cu-4Fe alloy was heated to 1,010° C.—a temperature between the solidus and liquidus temperatures (i.e., a thixoforming temperature)—and micrographs were taken at 0 seconds, 60 seconds, 300 seconds and 600 seconds. The micrographs show how the disclosed Ti-18Cu-4Fe alloy has a globular microstructure at 1,010° C. that becomes increasingly globular over time. Therefore, the disclosed Ti-18Cu-4Fe alloy is particularly well-suited for thixoforming.

EXAMPLE 3

Ti-20Cu-4Fe

Another specific, non-limiting example of the disclosed titanium-copper-iron alloy has the following nominal composition:

Ti-20Cu-4Fe and the measured composition shown in Table 5.

TABLE 5

| Element | Concentration (wt %) |
|---|---|
| Ti | Balance |
| Cu | 19.5 ± 0.5 |
| Fe | 4.0 ± 0.1 |
| O | 0.166 ± 0.010 |
| N | 0.008 ± 0.001 |

PANDAT™ software (version 2014 2.0) was used to generate liquid fraction versus temperature data for the disclosed Ti-20Cu-4Fe alloy, assuming both equilibrium conditions and Scheil conditions. The results are shown in FIGS. 2A (equilibrium conditions) and 2B (Scheil conditions). Based on the data from FIG. 2A (equilibrium conditions), the disclosed Ti-20Cu-4Fe alloy has a solidus temperature of about 999° C. and a liquidus temperature of about 1,309° C., with a solidification range of about 310° C. (329° C. using Scheil conditions/FIG. 2B).

Referring to FIG. 3B, the disclosed Ti-20Cu-4Fe alloy was heated to 1,010° C.—a temperature between the solidus and liquidus temperatures (i.e., a thixoforming temperature)—and micrographs were taken at 0 seconds, 60 seconds, 300 seconds and 600 seconds. The micrographs show how the disclosed Ti-20Cu-4Fe alloy has a globular microstructure at 1,010° C. that becomes increasingly globular over time. Therefore, the disclosed Ti-20Cu-4Fe alloy is particularly well-suited for thixoforming.

EXAMPLE 4

Ti-22Cu-4Fe

Yet another specific, non-limiting example of the disclosed titanium-copper-iron alloy has the following nominal composition:

Ti-22Cu-4Fe and the measured composition shown in Table 6.

TABLE 6

| Element | Concentration (wt %) |
|---|---|
| Ti | Balance |
| Cu | 21.5 ± 0.5 |
| Fe | 4.0 ± 0.1 |
| O | 0.176 ± 0.013 |
| N | 0.008 ± 0.001 |

PANDAT™ software (version 2014 2.0) was used to generate liquid fraction versus temperature data for the disclosed Ti-22Cu-4Fe alloy, assuming both equilibrium conditions and Scheil conditions. The results are shown in FIGS. 2A (equilibrium conditions) and 2B (Scheil conditions). Based on the data from FIG. 2A (equilibrium conditions), the disclosed Ti-22Cu-4Fe alloy has a solidus temperature of about 995° C. and a liquidus temperature of about 1,271° C., with a solidification range of about 276° C. (290° C. using Scheil conditions/FIG. 2B).

Referring to FIG. 3C, the disclosed Ti-22Cu-4Fe alloy was heated to 1,010° C.—a temperature between the solidus and liquidus temperatures (i.e., a thixoforming temperature)—and micrographs were taken at 0 seconds, 60 seconds, 300 seconds and 600 seconds. The micrographs show how the disclosed Ti-22Cu-4Fe alloy has a globular microstructure at 1,010° C. that becomes increasingly globular over time. Therefore, the disclosed Ti-22Cu-4Fe alloy is particularly well-suited for thixoforming.

Accordingly, discloses are titanium-copper-iron alloys that are well-suited for thixoforming. Also, disclosed are methods for manufacturing a metallic article, particularly a titanium alloy article, by way of thixoforming.

Figure 4:
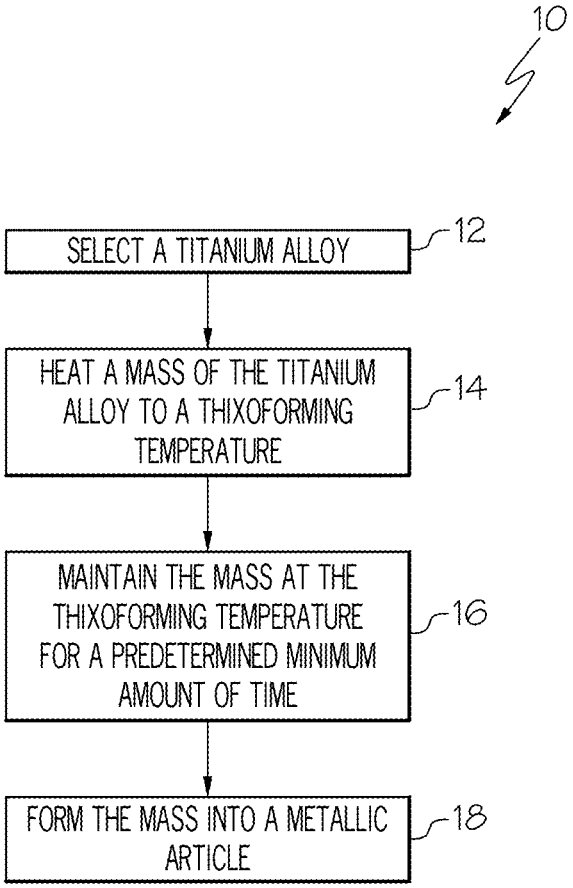
FIG. 4 is a flow diagram depicting one embodiment of the disclosed method for manufacturing a metallic article.

Referring now to FIG. 4, one embodiment of the disclosed method for manufacturing a metallic article, generally designated 10, may begin at Block 12 with the selection of a titanium alloy for use as a starting material. For example, the selection of a titanium alloy (Block 12) may include selecting a titanium-copper-iron alloy having the composition shown in Table 1, above.

At this point, those skilled in the art will appreciate that selection of a titanium alloy (Block 12) may include selecting a commercially available titanium alloy or, alternatively, selecting a non-commercially available titanium alloy. In the case of a non-commercially available titanium alloy, the titanium alloys may be custom made for use in the disclosed method 10.

As is disclosed herein, the solidification range may be one consideration during selection (Block 12) of a titanium alloy. For example, selection of a titanium alloy (Block 12) may include selecting a titanium-copper-iron alloy having a solidification range of at least 50° C., such as at least 100° C., or at least 150° C., or at least 200° C. or at least 250° C., or at least 300° C.

As is also disclosed herein, the temperature at which a liquid fraction between about 30 percent and about 50 percent is achieved may be another consideration during selection (Block 12) of a titanium alloy. For example, selection of a titanium alloy (Block 12) may include selecting a titanium-copper-iron alloy that achieves a liquid fraction between about 30 percent and about 50 percent at a temperature less than 1,200° C., such as a temperature less than 1,150° C., or a temperature less than 1,100° C., or a temperature less than 1,050° C.

At Block 14, a mass of the titanium alloy may be heated to a thixoforming temperature (i.e., a temperature between the solidus and liquidus temperatures of the titanium alloy). In one particular implementation, the mass of the titanium alloy may be heated to a particular thixoforming temperature, and the particular thixoforming temperature may be selected to achieve a desired liquid fraction in the mass of the titanium alloy. As one example, the desired liquid fraction may be about 10 percent to about 70 percent. As another example, the desired liquid fraction may be about 20 percent to about 60 percent. As yet example, the desired liquid fraction may be about 30 percent to about 50 percent.

At Block 16, the mass of the titanium alloy may optionally be maintained at the thixoforming temperature for a predetermined minimum amount of time prior to proceeding to the next step (Block 18). As one example, the predetermined minimum amount of time may be about 10 seconds. As another example, the predetermined minimum amount of time may be about 30 seconds. As another example, the predetermined minimum amount of time may be about 60 seconds. As another example, the predetermined minimum amount of time may be about 300 seconds. As yet another example, the predetermined minimum amount of time may be about 600 seconds.

At Block 18, the mass of the titanium alloy may be formed into a metallic article while the mass is at the thixoforming temperature. Various forming techniques may be used, such as, without limitation, casting and molding.

Accordingly, the disclosed titanium-copper-iron alloy and associated thixoforming method may facilitate the manufacture of net shape (or near net shape) titanium alloy articles at temperatures that are significantly lower than traditional titanium casting temperatures, and without the need for the complex/expensive tooling typically associated with plastic forming of titanium alloys. Therefore, the disclosed titanium-copper-iron alloy and associated thixoforming method have the potential to significantly reduce the cost of manufacturing titanium alloy articles.

Figure 5:
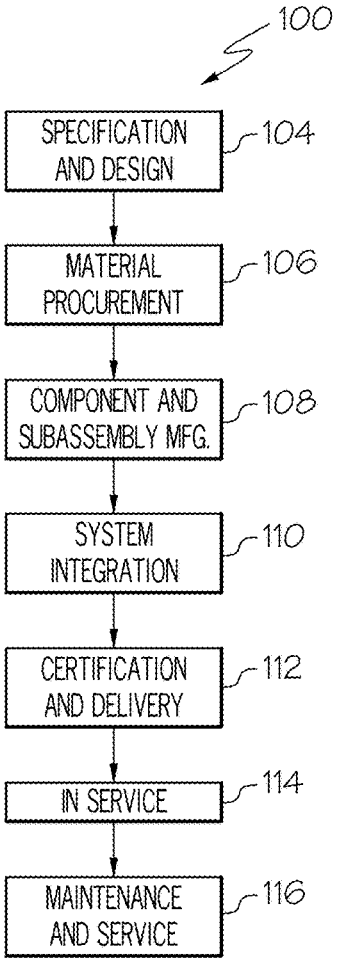
FIG. 5 is a flow diagram of an aircraft manufacturing and service methodology.
Figure 6:
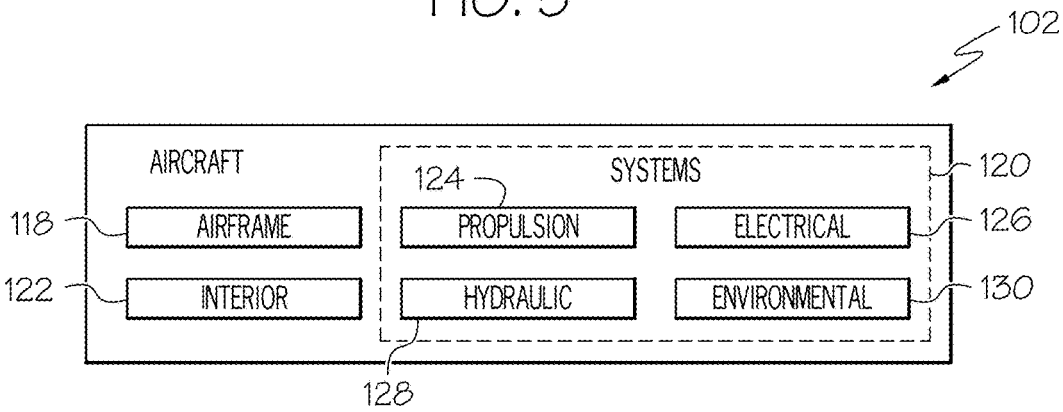
FIG. 6 is a block diagram of an aircraft.

Examples of the disclosure may be described in the context of an aircraft manufacturing and service method 100, as shown in FIG. 5, and an aircraft 102, as shown in FIG. 6. During pre-production, the aircraft manufacturing and service method 100 may include specification and design 104 of the aircraft 102 and material procurement 106. During production, component/subassembly manufacturing 108 and system integration 110 of the aircraft 102 takes place. Thereafter, the aircraft 102 may go through certification and delivery 112 in order to be placed in service 114. While in service by a customer, the aircraft 102 is scheduled for routine maintenance and service 116, which may also include modification, reconfiguration, refurbishment and the like.

Each of the processes of method 100 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 6, the aircraft 102 produced by example method 100 may include an airframe 118 with a plurality of systems 120 and an interior 122. Examples of the plurality of systems 120 may include one or more of a propulsion system 124, an electrical system 126, a hydraulic system 128, and an environmental system 130. Any number of other systems may be included.

The disclosed titanium-copper-iron alloy and associated thixoforming method may be employed during any one or more of the stages of the aircraft manufacturing and service method 100. As one example, components or subassemblies corresponding to component/subassembly manufacturing 108, system integration 110, and or maintenance and service 116 may be fabricated or manufactured using the disclosed titanium-copper-iron alloy and associated thixoforming method. As another example, the airframe 118 may be constructed using the disclosed titanium-copper-iron alloy and associated thixoforming method. Also, one or more apparatus examples, method examples, or a combination thereof may be utilized during component/subassembly manufacturing 108 and/or system integration 110, for example, by substantially expediting assembly of or reducing the cost of an aircraft 102, such as the airframe 118 and/or the interior 122. Similarly, one or more of system examples, method examples, or a combination thereof may be utilized while the aircraft 102 is in service, for example and without limitation, to maintenance and service 116.

The disclosed titanium-copper-iron alloy and associated thixoforming method is described in the context of an aircraft; however, one of ordinary skill in the art will readily recognize that the disclosed titanium-copper-iron alloy and associated thixoforming method may be utilized for a variety of applications. For example, the disclosed titanium-copper-iron alloy and associated thixoforming method may be implemented in various types of vehicle including, for example, helicopters, passenger ships, automobiles, marine products (boat, motors, etc.) and the like. Various non-vehicle applications, such as medical applications, are also contemplated.

Although various embodiments of the disclosed titanium-copper-iron alloy and associated thixoforming method have been shown and described, modifications may occur to those skilled in the art upon reading the specification. The present application includes such modifications and is limited only by the scope of the claims.

What is claimed is:

1. A method for manufacturing a metallic article comprising:

heating a mass of titanium alloy to a thixoforming temperature, said thixoforming temperature being between a solidus temperature of said titanium alloy and a liquidus temperature of said titanium alloy, said titanium alloy consisting of:

5 to 33 percent by weight copper;

1 to 8 percent by weight iron; and balance titanium and impurities; and forming said mass of titanium alloy into said metallic article while said mass of titanium alloy is at said thixoforming temperature.

2. The method of claim 1 further comprising maintaining said mass of titanium alloy at said thixoforming temperature for at least 60 seconds prior to said forming said mass of titanium alloy into said metallic article.

3. The method of claim 1 further comprising maintaining said mass of titanium alloy at said thixoforming temperature for at least 600 seconds prior to said forming said mass of titanium alloy into said metallic article.

4. The method of claim 1 further comprising selecting said titanium alloy such that a difference between said solidus temperature and said liquidus temperature is at least 200° C.

5. The method of claim 1 further comprising selecting said titanium alloy such that a difference between said solidus temperature and said liquidus temperature is at least 250° C.

6. The method of claim 1 further comprising selecting said titanium alloy to have a liquid fraction between about 30 percent and about 50 percent at a temperature less than 1,100° C.

7. The method of claim 1 wherein:

said copper is present in said titanium alloy at about 13 to about 33 percent by weight; and said iron is present in said titanium alloy at about 3 to about 5 percent by weight.

8. The method of claim 1 further comprising selecting said titanium alloy to have a liquid fraction between about 30 percent and about 50 percent at said thixoforming temperature.

9. The method of claim 1 wherein said copper is present in said titanium alloy at about 13 to about 33 percent by weight.

10. The method of claim 1 wherein said copper is present in said titanium alloy at about 15 to about 30 percent by weight.

11. The method of claim 1 wherein said copper is present in said titanium alloy at about 17 to about 25 percent by weight.

12. The method of claim 1 wherein said copper is present in said titanium alloy at about 18 to about 22 percent by weight.

13. The method of claim 1 wherein said iron is present in said titanium alloy at about 2 to about 7 percent by weight.

14. The method of claim 1 wherein said iron is present in said titanium alloy at about 3 to about 5 percent by weight.

15. The method of claim 1 wherein said iron is present in said titanium alloy at about 4 percent by weight.

16. The method of claim 1 wherein oxygen is present in said titanium alloy as an impurity at a concentration of at most about 0.25 percent by weight.

17. The method of claim 1 wherein nitrogen is present in said titanium alloy as an impurity at a concentration of at most about 0.03 percent by weight.

18. The method of claim 1 wherein a microstructure of said titanium alloy is globular while at said thixoforming temperature.

19. The method of claim 1 wherein said forming said mass of titanium alloy into said metallic article while said mass of titanium alloy is at said thixoforming temperature comprises casting.

20. The method of claim 1 wherein said forming said mass of titanium alloy into said metallic article while said mass of titanium alloy is at said thixoforming temperature comprises molding.

* * * * *